US010227836B2

(12) United States Patent
Karimi et al.

(10) Patent No.: US 10,227,836 B2
(45) Date of Patent: Mar. 12, 2019

(54) SYSTEM AND METHOD FOR MANAGED PRESSURE WELLBORE STRENGTHENING

(71) Applicant: Weatherford/Lamb, Inc., Houston, TX (US)

(72) Inventors: Mojtaba Karimi, Houston, TX (US); Don Hannegan, Fort Smith, AR (US); Mojtaba P. Shahri, Houston, TX (US); Ovunc Mutlu, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 970 days.

(21) Appl. No.: 14/261,914

(22) Filed: Apr. 25, 2014

(65) Prior Publication Data

US 2015/0308209 A1 Oct. 29, 2015

(51) Int. Cl.

| | |
|---|---|
| ***E21B 21/00*** | (2006.01) |
| ***E21B 43/26*** | (2006.01) |
| ***E21B 21/08*** | (2006.01) |
| *E21B 43/267* | (2006.01) |

(52) U.S. Cl.

CPC ..... *E21B 21/003* (2013.01); *E21B 21/08* (2013.01); *E21B 43/26* (2013.01); *E21B 43/267* (2013.01)

(58) Field of Classification Search

CPC ..... E21B 33/00; E21B 43/26; E21B 43/261; E21B 43/267; E21B 33/138; E21B 21/003; E21B 21/08

See application file for complete search history.

(56) References Cited

U.S. PATENT DOCUMENTS

| | | | | |
|---|---|---|---|---|
| 4,355,784 | A | 10/1982 | Cain | |
| 7,044,237 | B2 | 5/2006 | Leuchtenberg | |
| 7,278,496 | B2 | 10/2007 | Leuchtenberg | |
| 7,367,411 | B2 | 5/2008 | Leuchtenberg | |
| 7,650,950 | B2 | 1/2010 | Leuchtenberg | |
| 8,360,170 | B2 * | 1/2013 | Leuchtenberg | E21B 21/08 175/25 |
| 8,393,411 | B2 * | 3/2013 | Dupriest | C09K 8/03 175/40 |
| 8,636,087 | B2 * | 1/2014 | Hannegan | E21B 21/00 166/77.53 |
| 2010/0282470 | A1 | 11/2010 | Alberty et al. | |

(Continued)

FOREIGN PATENT DOCUMENTS

| | | | |
|---|---|---|---|
| EP | 2251524 | A1 | 11/2010 |
| WO | 2007/092956 | A2 | 8/2007 |
| WO | 2012170382 | A1 | 12/2012 |

OTHER PUBLICATIONS

PCT Search Report and written opinion in co-pending PCT Application No. PCT/US2015/024981 dated Oct. 6, 2015, 11 pages.

(Continued)

*Primary Examiner* — Michael R Wills, III

(74) *Attorney, Agent, or Firm* — Blank Rome LLP

(57) ABSTRACT

Systems and methods for wellbore strengthening are disclosed. An effective way to strengthen a wellbore and prevent future fractures during drilling operations is to induce fractures having a desired fracture width profile and fracture length. Surface back pressure can be used to accurately induce such fractures. The induced fractures which are then sealed can increase fracture gradient of the wellbore thus mitigating future fractures.

40 Claims, 7 Drawing Sheets

(56) References Cited

U.S. PATENT DOCUMENTS

| | | | | |
|---|---|---|---|---|
| 2012/0211279 | A1* | 8/2012 | Neidhardt | E21B 7/20 175/40 |
| 2013/0118752 | A1* | 5/2013 | Hannegan | E21B 47/0005 166/336 |
| 2014/0238998 | A1* | 8/2014 | Schwing, III | A47J 27/002 220/573.2 |

OTHER PUBLICATIONS

Aston, M. S., et al, "Drilling Fluids for Wellbore Strengthening", BP Exploration, IADC Drilling Conference, Mar. 2-4, 2004, IADC/SPE 87130, 8 pages.
Alberty, Mark W., "A Physical Model for Stress Cages", SPE 90493, Society fo Petroleum Engineers, Inc., Sep. 26-29, 8 pages.
Nguyen, Well Design—Spring 2013, New Mexico Well Design, PE 413, Chapter 1: Fracture Pressure, 2013, 44 pages.
First Office Action in counterpart Canadian Appl. 2,946,722, dated Aug. 23, 2017, 5-pgs.
Examination Report filed in counterpart Australian Application No. 2015250158 dated Apr. 10, 2017, 4 Pages.
Search Report filed in counterpart GB Application No. GB1617839.4 dated Mar. 27, 2017, 2 Pages.
Second Examination Report filed in counterpart AU Appl. 2015250158, dated Nov. 22, 2017, 3-pgs.

* cited by examiner

SYSTEM AND METHOD FOR MANAGED PRESSURE WELLBORE STRENGTHENING

TECHNICAL FIELD

This disclosure relates generally to the field of drilling wellbores and in particular to methods and systems for strengthening a wellbore.

BACKGROUND

In drilling of wells, drilling fluid is generally circulated through a drill string and drill bit and then back to the surface of the wellbore being drilled. At the surface, the fluid is processed to remove cuttings and to maintain desired properties before it is recirculated back to the well. During drilling operations, some amount of this drilling fluid may be lost due to various factors. This loss of drilling fluid may be referred to as lost circulation. Lost circulation is one of the largest contributors to non-productive time in drilling operations. This is particularly true for wells being drilled in complex geological settings such as deep water or highly depleted zones or intervals. Thus, it is important to determine the causes of lost circulation and try to mitigate those factors.

One major factor that has been identified to cause lost circulation is the formation of fractures in the wellbore wall. These fractures provide an outlet for the drilling fluid to escape from and thus result in loss of fluids. Losses caused by factures are particularly troublesome, as they can be uncontrollable in large volumes. To prevent or mitigate wellbore losses, an engineering practice referred to as wellbore strengthening may be conducted to increase the pressure at which a fracture will form in the wellbore wall, known as fracture gradient (FG), or to prevent already created fracture(s) from further propagation.

Wellbore strengthening involves sealing existing natural fractures or induced fractures with materials having properties that are conducive to sealing of the wellbore wall to mitigate further fracture propagation. In general, to conduct a successful wellbore strengthening operation, width of a fracture at the wellbore wall (i.e. fracture width profile) has to be determined. This allows accurately engineering lost circulation material to have a suitable particle size distribution that can seal the fracture at the wellbore wall.

Conventional wellbore strengthening applications generally involve optimizing drilling fluid particle size distribution to seal fractures created during drilling operation. However, wellbore strengthening may also involve creating intentionally induced fractures that are then sealed. This has been shown to mitigate initiation and propagation of new fractures around the wellbore. To create intentionally induced fractures, mud weight can be used to exert extra pressure on the formation. When pressure exerted by mud weight exceeds FG of the wellbore at a particular point in the well, a fracture is created at that point.

However, because of difficulties associated with having a precise mud weight at particular locations in the well and because of uncertainties associated with drilling operations, it is difficult to control the accuracy of the process. Imprecise pressure at the wellbore wall might cause uncontrollable growth of induced fractures. This can result in fractures that have unacceptably larger widths and/or ones that extend too long into the formation. The following disclosure addresses these and other issues.

SUMMARY

In one embodiment the inventive concept provides a method for strengthening a wellbore, which applies surface back pressure to at least one region of the wellbore to induce at least one fracture in the region, and then seals the induced fracture. The induced fracture has a specific fracture length and width and it increases fracture gradient of the adjacent region.

In another embodiment, the inventive concept provides a method for strengthening a wellbore, where the method includes providing a drilling tool having a pressure regulator, a programmable logic controller communicatively coupled to the pressure regulator. The method then involves determining, using the programmable logic controller and/or a geomechanical engine, an amount of pressure required to induce a fracture having a specific length and width profile and communicating the amount of pressure required to the pressure regulator. The method then applies, using the pressure regulator, the amount of pressure to the wellbore to induce the desired fracture to be sealed with fluid particles.

In yet another embodiment, the inventive concept provides a system for strengthening a wellbore, where the system includes a pressure regulator, a programmable logic controller communicatively coupled to the pressure regulator. The programmable logic controller determines an amount of pressure required to induce a fracture having a specific length and width profile in the wellbore and communicates the amount of pressure to the pressure regulator, and the pressure regulator applies the amount of pressure to the wellbore.

DESCRIPTION OF DISCLOSED EMBODIMENTS

Figure 1:
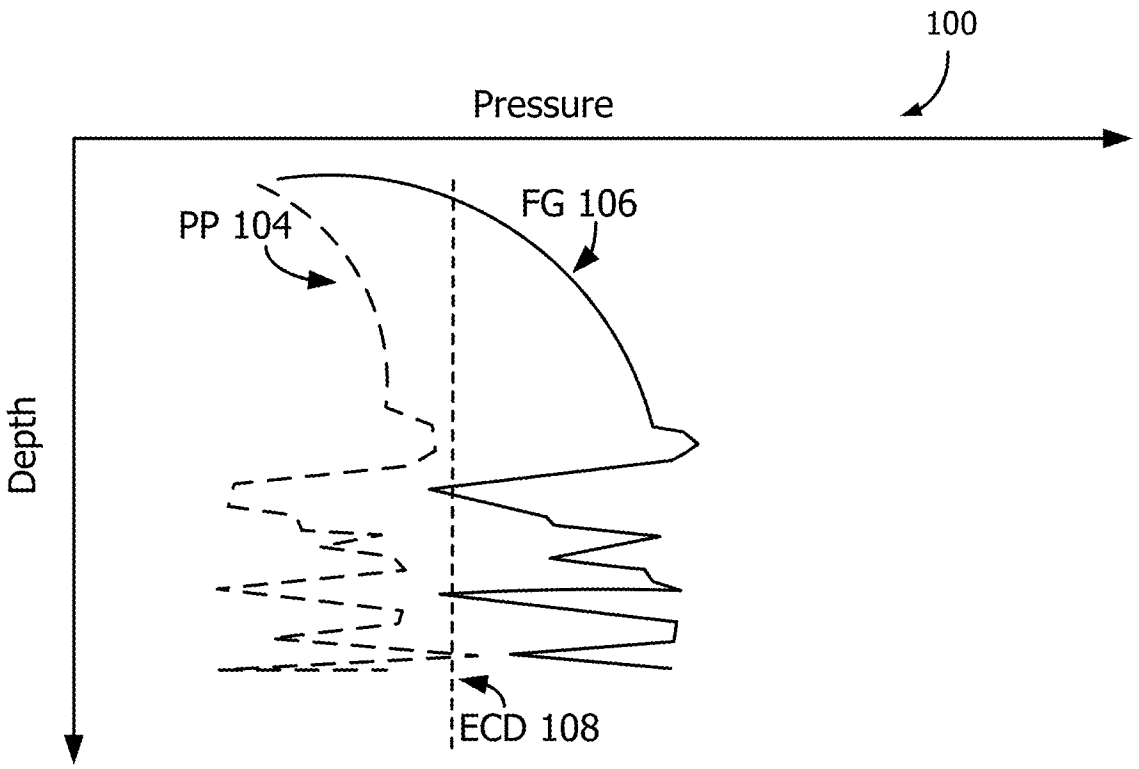
FIG. 1 is a graph of depth versus pressure and fracture gradient during drilling of a wellbore, according to one or more disclosed embodiments.

Loss of circulation due to fracture initiation and propagation in the wellbore wall is a major problem in drilling operations, as it is costly and may result in well control problems. Additionally, if left untreated, undesired fractures could threaten the integrity of the entire wellbore. Various wellbore strengthening techniques have been developed over the years to address this issue. One such technique involves sealing induced fractures with proper fluid particle size distribution to increase near wellbore hoop stress and fracture gradient. The increase in fracture gradient is generally controlled by the width and length of the induced fracture as well as seal/plug location. Therefore, it is important to keep the width and length of fractures under control for a successful strengthening operation. Mud weight was used in the past to create such induced fractures. However, because of uncertainties in wellbore operations and difficulty in controlling mud weight, it is challenging to control the size of induced fractures using mud weight. These issues can be addressed by using surface back pressure to induce fractures for wellbore strengthening. Use of surface back pressure increases the accuracy of the entire process and enhances control over fracture growth.

Various factors can affect the formation of a fracture in a wellbore. One of the most important of these factors may be the fracture gradient (FG) of the wellbore. Fracture gradient is proportional to the amount of pressure a specific location or region of the wellbore wall is able to sustain before a fracture is formed there, and can be calculated by this pressure divided by the depth of the well at that location. The amount of fracture gradient is often a function of several factors, including but not limited to mechanical properties of the formation, pore pressure, wellbore trajectory, depth, and far-field in-situ stress state/regime. Therefore, fracture gradient varies along a wellbore.

An induced fracture is generally created in a wellbore if the pressure applied on the wellbore wall exceeds FG. The amount of the pressure applied generally corresponds directly with the drilling fluid's mud density or weight. Mud weight can be expressed as mass per unit volume, e.g., pounds per gallon (ppg) and is generally the density that an amount of fluid must have to exert a given gradient of pressure.

During drilling operations when drilling fluid is being circulated, additional pressure is generally applied against the wellbore wall caused by friction-induced pressure drop. Thus, this additional frictional pressure drop must be added to mud density to find the total pressure applied on the wellbore wall during drilling operations. This total pressure is referred to as equivalent circulating density (ECD) of a drilling fluid. The ECD is generally equal to the dynamic pressure drop from a particular location of the wellbore to the surface, plus the static head of the fluid caused by its density. In general, to maintain safe drilling procedures and prevent undesired fractures from forming in the wellbore wall, the ECD pressure needs to be maintained in between the pore pressure and fracture gradient of the wellbore at any given location. This is illustrated in FIG. 1.

FIG. 1 illustrates a graph showing pore pressure and fracture gradients of an example wellbore versus the depth of the wellbore. As can be seen, the pressure applied by the drilling fluids circulating the well ECD 108 is generally selected such that it is kept in between the pore pressure PP 104 and fracture gradient FG 106 lines. However, because of low fracture gradient in certain regions of the well, the ECD 108 line may have to cross one or both of the pressure lines 104 and 106. Fractures are highly likely to occur at locations where the ECD 108 crosses fracture gradient 106. To prevent creation of fractures at such locations, casing strings have been historically used to isolate the low fracture gradient zones. This is generally done by drilling a wellbore to a depth where the ECD creates a wellbore pressure approaching the fracture gradient of the formation adjacent to the wellbore and then installing a casing string at that depth to stabilize the formation. The casing string helps prevent creation of fractures and can also prevent collapse of the wellbore. Installing casing strings however, is costly, difficult, and time consuming. Additionally, having more casing strings may limit production capacity of the well. As a result, drilling deep wellbores can become too expensive and impractical due to the number of casing strings needed to complete the well and the reduction in casing and hole size that may occur with each casing string installed.

To avoid having to use additional casing strings, other wellbore strengthening techniques of preventing formation of unintended fractures have been used. One type of commonly used wellbore strengthening technique involves increasing the fracture gradient of the formation such that it can be kept above the ECD wellbore pressure. Fracture gradient can be increased by intentionally creating a fracture and then plugging and holding the fracture open by inserting solid materials in the fracture. Holding the fracture open or widening it can cause the formation in the immediate region of the wellbore to be compressed. The compression generally results in an increase in hoop stress around the wellbore, thus increasing the pressure needed to form additional fractures in the wellbore. In addition, plugging the fracture dis-communicates the pressure from the fracture tip and mitigates further fracture propagation. To prevent loss of drilling fluid through the intentionally induced fracture, a lost circulation material (LCM) can be pumped into the wellbore and inserted into the fracture. Other screen out techniques can also be used to seal the induced fractures. LCM can prevent additional fluid losses through the fracture, widen the fracture to increase FG at different points around the wellbore, and increase fracture propagation resistance of the induced fracture itself (i.e. Fracture Re-Initiation Pressure, FRIP) by dis-communicating the pressure inside the wellbore and fracture tip. In this manner, the induced fracture, if engineered correctly, can inhibit loss of drilling fluids by invoking multiple wellbore strengthening mechanisms. Engineering design of a fracture requires an accurate control of fracture characteristics such as length and width profile by applying the right amount of pressure on wellbore wall.

Because of significant uncertainties in downhole conditions, forming a fracture having a specific width and length through controlling drilling fluid weight can be difficult. In addition, it may be hard to change the mud weight in short periods of time during drilling operations since it requires addition of weighting materials. Examples of uncertainties that make the process more difficult are unexpected variations in rock properties, permeability, pore pressure, natural fractures, and variability in execution of field procedures.

In addition to lack of precision and difficulty in controlling induced fracture characteristics using drilling fluid weight, it may also be advantageous to use a technique that can be performed during both continuous and discrete drilling operations. The vast majority of currently used wellbore strengthening techniques are performed for discrete operations, and are thus conducted after the formation interval is fully exposed and drilling stops. This means fluid losses may occur during the drilling operation before wellbore strengthening is performed. Moreover, the additional time required to perform wellbore strengthening after drilling has stopped can be costly, as drilling equipment costs continue during the non-productive time required to stop and strengthen the wellbore.

These problems and more are addressed by embodiments discussed in this disclosure that induce fractures by using surface back pressure instead of pressure exerted by adjusting drilling fluid weight. Use of surface back pressure is advantageous as the amount of pressure applied is more precise. Moreover, surface back pressure can be applied from the surface and is thus not affected by variations in downhole conditions. Additionally, using surface back pressure instead of drilling fluid weight to create induced fractures allows for more flexibility in choosing the drilling fluid weight. The technique of using surface back pressure for inducing fractures which strengthen the wellbore may be referred to as managed pressure wellbore strengthening (MPWS).

Surface back pressure can be applied in a variety of different manners. For example, surface back pressure can be applied with a back pressure control or choke system, such as those proposed in U.S. Pat. Nos. 4,355,784; 7,044,237; 7,278,496; and 7,367,411; and 7,650,950, which are all incorporated herein by reference. A hydraulically operated choke may also be used along with any known regulator or choke valve. In one embodiment, the choke valve and system may have a dedicated hydraulic pump and manifold system as a positive displacement mud pump is used for circulating drilling fluids. An alternative embodiment may include a system of choke valves, choke manifold, flow meter, and/or hydraulic power units to actuate the choke valves, as well as sensors and an intelligent control unit. Such a system may be capable of measuring return flow using a flow meter installed in line with the choke valves, and to detect either a fluid gain or fluid loss very early, allowing gain/loss volumes to be minimized while a fracture is being induced.

Surface back pressure can also be applied in a Managed Pressure Drilling (MPD) system. MPD is an adaptive drilling process generally used to control the annulus pressure profile throughout a wellbore. An MPD system is able to ascertain downhole pressure environmental limits and to manage the hydraulic annulus pressure profile accordingly. An MPD can be applied in rotating control devices (RCDs). International Pub. No. WO 2007/092956, which is hereby incorporated by reference, proposes such a system.

RCDs have been used in the drilling industry for drilling wells for some time, and in recent years RCDs have been used to contain annular fluids under pressure, and thereby manage the pressure within the wellbore relative to fracture gradient and pressure in the formation. In one embodiment, such an RCD may include a back pressure regulator or choke system that can be used to induce fractures in the wellbore. The choke system used may be a manual choke valve, a semi-automatic choke valve and/or a fully automatic choke valve.

Figure 2A:
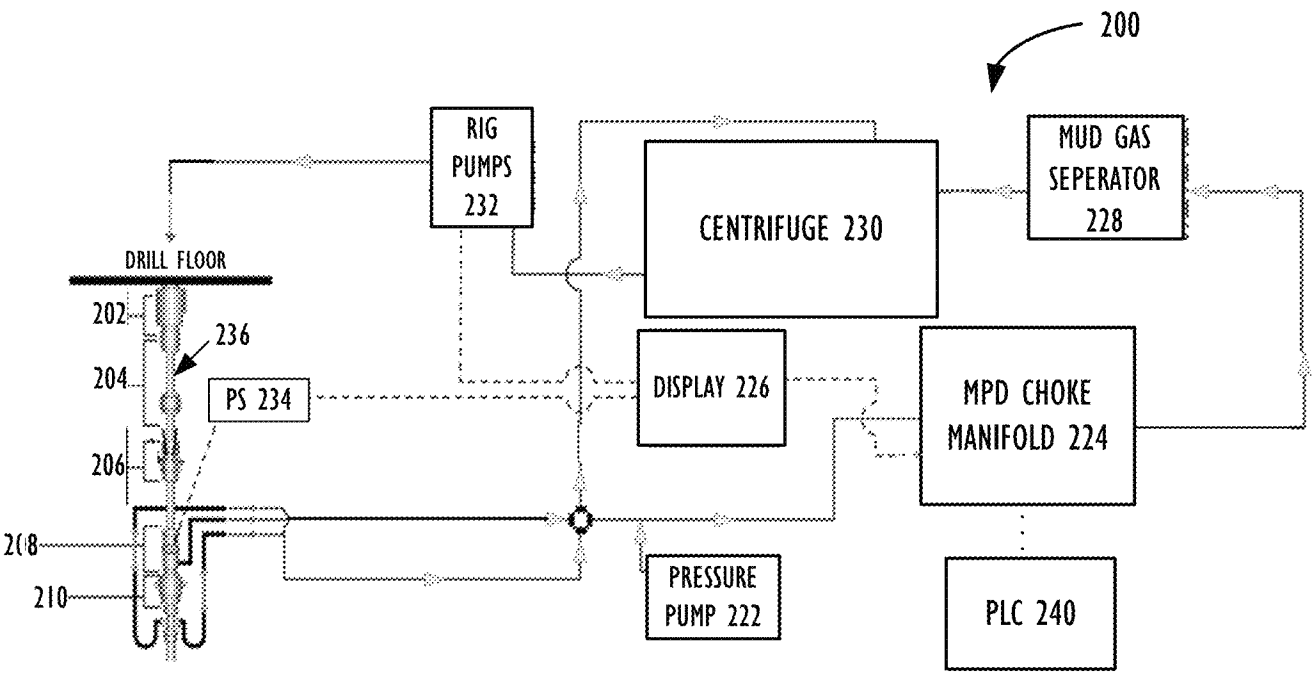
FIG. 2A is a cut away section view of a drilling system having a rotating control device and a pressure regulator, according to one or more disclosed embodiments.

FIG. 2A illustrates one embodiment of a rotating control device (RCD) 208 that uses a pressure regulator for applying surface back pressure. The drilling system 200 of FIG. 2A includes a marine diverter 202 coupled to a telescoping slip joint 204 which in turn connects to a drilling string 236. On the opposite side, the drilling string 236 connects to a riser tension ring 206 which in turn connects to the RCD 208. The RCD 208 is also coupled on the lower side to an annular preventer or blowout preventer 210. The elements shown in FIG. 2A are not described in detail as a person of skill in the art would be readily familiar them and their functions.

A pressure regulator, such as an MPD choke manifold 224, is in fluid communication with the RCD 208. Pressure regulator or choke valve 224 can be in electrical connection with a programmable logic controller (PLC), such as PLC 240. Utilizing a geomechanical engine (not shown), PLC 240 can determine the amount of pressure that should be applied by the pressure regulator to induce a fracture having a predetermined opening width and length at a particular location, and can provide this information to the pressure regulator or choke manifold 224 for adjusting it. In one embodiment, the PLC 240 instructs the pressure regulator or choke manifold 224 to adjust its setting to achieve the desired amount of pressure. If the adjusted setting of the pressure regulator fails to achieve the desired induced fracture, the settings may be readjusted until a fracture is initiated. Because the amount of pressure required to initiate a fracture may be different than the amount of pressure required to propagate the fracture to a specific width, length, and height, in one embodiment, the geomechanical engine calculates both the amount of pressure required to initiate the fracture and the amount of pressure required to propagate it to the desired size. In such an embodiment, the amount of pressure required to initiate the fracture may first be applied, and then that amount may be adjusted to the amount of pressure required to propagate the fracture to achieve a desired fracture geometry. Once the desired fracture geometry is achieved, then the fracture may be plugged to prevent further fluid loss.

The geomechanical engine may be coupled to the PLC 240 and may integrate mechanical property, in-situ stress, reservoir and wellbore trajectory information to calculate the amount of pressure required to create a certain fracture length and width as well as the amount of strengthening this fracture would provide upon sealing. For example the geomechanical engine may calculate the increase in fracture gradient caused by the induced fracture. In one embodiment, the geomechanical engine may also calculate the amount of increase in fracture gradient required to minimize the number of casing strings needed for the wellbore. In such an embodiment, the geomechanical engine may also calculate the amount of surface back pressure required to induce a fracture causing the calculated amount of increase in fracture gradient. One such geomechanical engine is described in the co-pending application entitled "System and Method for Integrated Wellbore Stress, Stability and Strengthening Analysis," the contents of which are incorporated by reference herein.

In an alternative embodiment, the amount of surface back pressure required to induce an intended fracture may be obtained by using wellbore ballooning fingerprint data. By quantifying ballooning at a given depth, the amount of pressure required may be calculated.

Figure 2B:
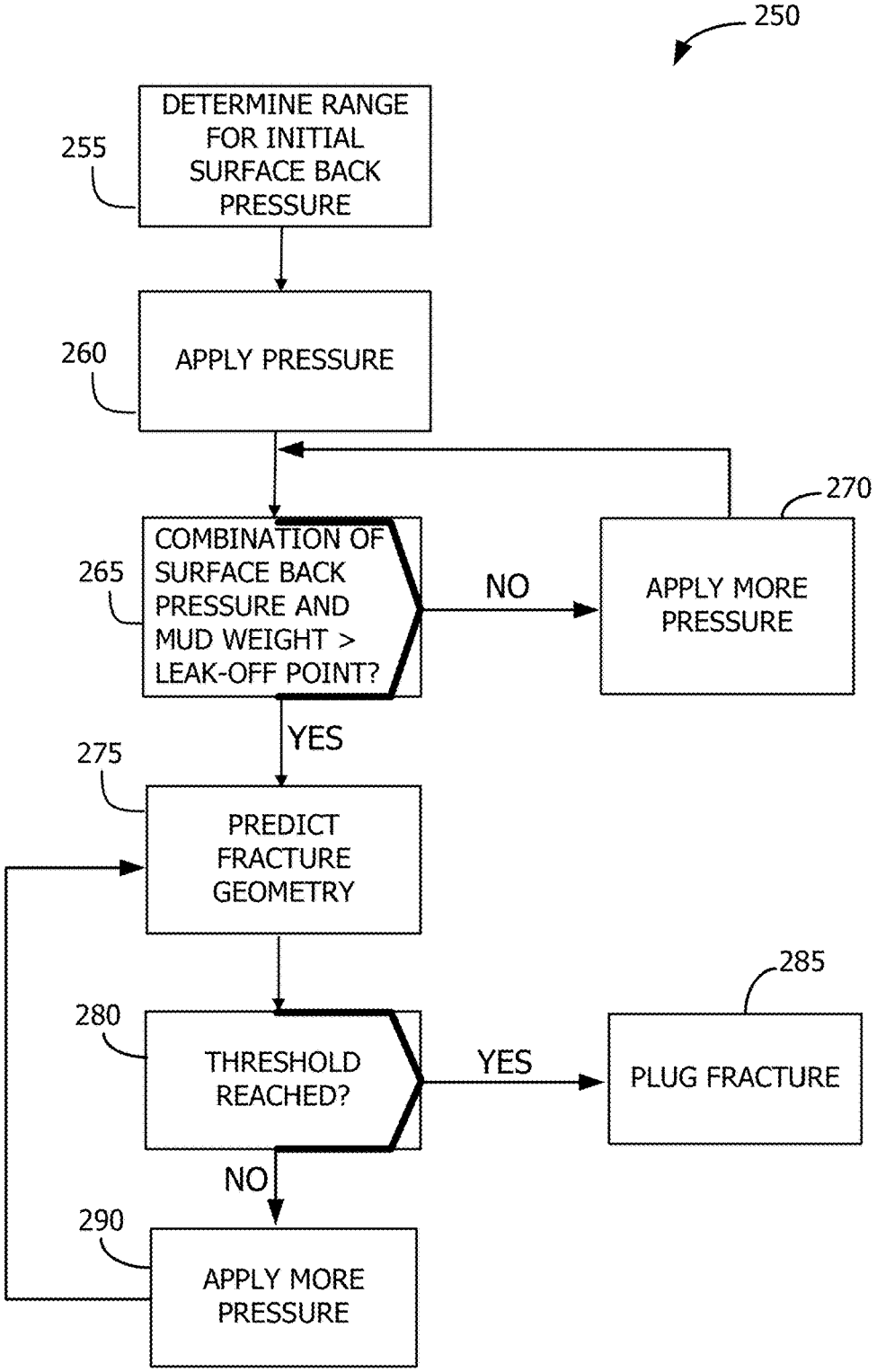
FIG. 2B is a flow chart for incrementally increasing surface back pressure until a desired fracture geometry is achieve, in accordance with one embodiment.

In alternative embodiments, the amount of pressure required to induce the fracture may not be calculated. Instead, the pressure applied by the pressure regulator or choke manifold 224 may be incrementally adjusted until a fracture initiation is observed. This may be achieved by observing characteristic changes in measured pressure. In such an embodiment, the PLC 240 may then be used to determine and control further adjustments in order to achieve the desired fracture geometry. In one embodiment, the initial pressure applied by the pressure regulator in this manner may be determined by first defining a desired range of pressure at which a stable fracture can be induced. This may be done by performing and/or using data from an offset leak-off test. FIG. 2B illustrates a flow chart for applying surface back pressure in this manner.

In accordance with one embodiment, operation 250 for incrementally increasing surface back pressure to achieve a desired fracture geometry begins by determining a desired range of numbers at which initial surface back pressure can be applied (block 255). As discussed above this range may be determined by analyzing data from a leak-off test. Once the range had been determined, an amount of pressure from this range is selected to apply the initial surface back pressure (block 260). Then, the process calculates whether the combination of the initial surface back pressure being applied and the mud weight is more than the leak-off point (block 265). If the combination is not more than the amount indicated by the leak-off test, more surface back pressure is applied (block 270). If the combination is more than the amount indicated by the leak-off test, then the geometry of the induced fracture is predicted (block 275). This may be done by the geomechanical engine and communicated to the PLC 240. The prediction may include calculating fracture geometry and the threshold for unstable propagation of the induced fracture. Once this threshold is calculated, the process determines if the fracture has reached this critical threshold (block 280). If the threshold has been reached, the process applies strengthening material to plug the fracture (block 285). If the threshold has not been reached, more surface back pressure is applied (block 290) and the process moves back to predict the fracture geometry based on the increased pressure (block 275). The process may be repeated until the threshold pressure is reached and the fracture is plugged.

As discussed above, the pressure regulator can be manual, semi-automatic or automatic. The pressure regulator may also be either hydraulic or electronic. The electrical connection between the pressure regulator and the PLC may be hard wired, wireless or a combination of wired and wireless. In one embodiment, for a hydraulic pressure regulator, PLC 240 may transmit hydraulic pressure to adjust the pressure regulator, e.g. set the pressure regulator or choke valve. In such an embodiment, a pressure pump 222 may be used to control the choke valve.

MPD choke manifold 224 is also in electrical connection with a display 226, which in turn is in electrical connection with a rig pump 232 and a sensor 234. In one embodiment, the display 226 may be a remote data acquisition and display device used to display information such real-time flow of fluid in and out of the wellbore. Sensor 234 may be used to measure pressure and/or temperature. The rig pump 232 may be used to pump fluid into the wellbore. The fluid pumped by the rig pump 232 may be water or drilling fluid such as mud. The MPD choke manifold 224 is also in communication with a Mud gas separator 228, which is in turn in communication with a centrifuge 230.

By using the pressure regular or choke manifold 224 to apply a specific amount of surface back pressure, one or more fractures having a specific desired width and length may be induced in the wellbore wall. Thus, the RCD 208 can be used to apply managed pressure for wellbore strengthening. As discussed above, other types of RCDs and pressure regulators can also be used for applying surface back pressure for wellbore strengthening. In another embodiment, a desired surface back pressure may be applied by adjusting the pumping rate of one or both of the rig pump 232 and pressure pump 222.

It should also be noted that, in one embodiment, the drilling tool used to apply surface back pressure may be a blowout preventer. Alternatively, the drilling tool may be a diverter. When using a blowout preventer or a diverter, the process may involve drilling to a certain depth, stopping the drilling, closing the blowout preventer or diverter, and then initiating and propagating a fracture. Once the desired fracture geometry is achieved, the fracture may be plugged, the blowout preventer or diverter may be opened, and then drilling would resume.

The technique of applying surface back pressure using a pressure regulator for wellbore strengthening can be performed in both discrete and continuous forms. For example, in discrete form, the technique can be done in the form of a pill to strengthen a low pressure region of the wellbore. In continuous form, the procedure can be performed while drilling.

In addition to both discrete and continuous forms, when applied in an MPD operation, the technique can also be done after drilling has been completed, before running the casing to make sure that the casing can be run safely. For example, the practice can be done after each MPD application to ensure the well can tolerate the swab and/or surge pressure during running of the casing and/or the liner. This is particularly useful, as there are times a wellbore is successfully drilled with MPD, however, fluid losses are still incurred while running the casing or while cementing. Implementing MPWS, by for example using the existing MPD kit can overcome this problem efficiently and quickly.

In addition to the embodiments discussed above, the MPWS technique can also be applied after drilling has been completed and casing has been run, before cementing the wellbore to ensure that cementing can be completed without incurring losses and nullifying the benefits gained by MPD. In alternate embodiments, the MPWS technique can be performed while pumping the cement flush or while pumping the cement slurry. For example, the technique might be done as a complement to closed-loop cementing procedures and can be done while flushing drilling mud and cuttings from the wellbore in preparation for cement.

Incorporating MPWS into an MPD operation also allows for continuous quantification of the integrity improvements provided by the MPWS via performing dynamic leak off or formation integrity tests. The MPWS technique can be applied if formation integrity tests conducted while drilling the wellbore with a MPD kit indicate the need for wellbore strengthening. Wellbore strengthening by applying MPWS can provide added integrity which may help avoid wellbore instability problems due to surge pressures associated with a planned casing program and help ensure pressures associated with anticipated cementing sequences will not exceed the newly known limit of wellbore integrity. Without wellbore strengthening, induced fractures may unexpectedly create several operational problems such as consuming an amount of the pre-calculated volume of slurry required for successful zonal isolation while cementing.

While running a casing string, surge pressures may destabilize the wellbore by exceeding the fracture gradient at that depth. By applying the MPWS technique, these problems may be avoided. Thus, there are various options available for applying managed pressure wellbore strengthening as it can be performed during different phases of the drilling operation. These various options provide flexibility and give operators a choice to choose the most efficient and least costly option. Alternatively, when needed, the operators may choose to apply MPWS during two or more phases of the drilling operation.

Another advantage of using surface back pressure for creating induced fractures is a significant improvement over control of the growth of the fracture. As discussed above, the width of a fracture is directly related to the increase of fracture gradient caused by the induced fracture plugging mechanism. By using MPWS, the amount of PSI pressure applied to the wellbore is increased, as opposed to increasing the mud weight PPGs, as done conventionally. This provides more precision and control over the amount of pressure applied, such that growth of the fracture can be more closely monitored and controlled. Thus a desired fracture length and width profile may be achieved more effectively. The desired fracture length and width profile may be determined using a geomechanical engine.

Inducing fractures using extra surface back pressure instead of increased mud weight also provides more flexibility in the amount of mud weight used. Furthermore, the MPWS technique can eliminate the need for setting additional strings by modifying formation pressure profile changes. This is illustrated in FIGS. 3A-3D.

Figure 3A:
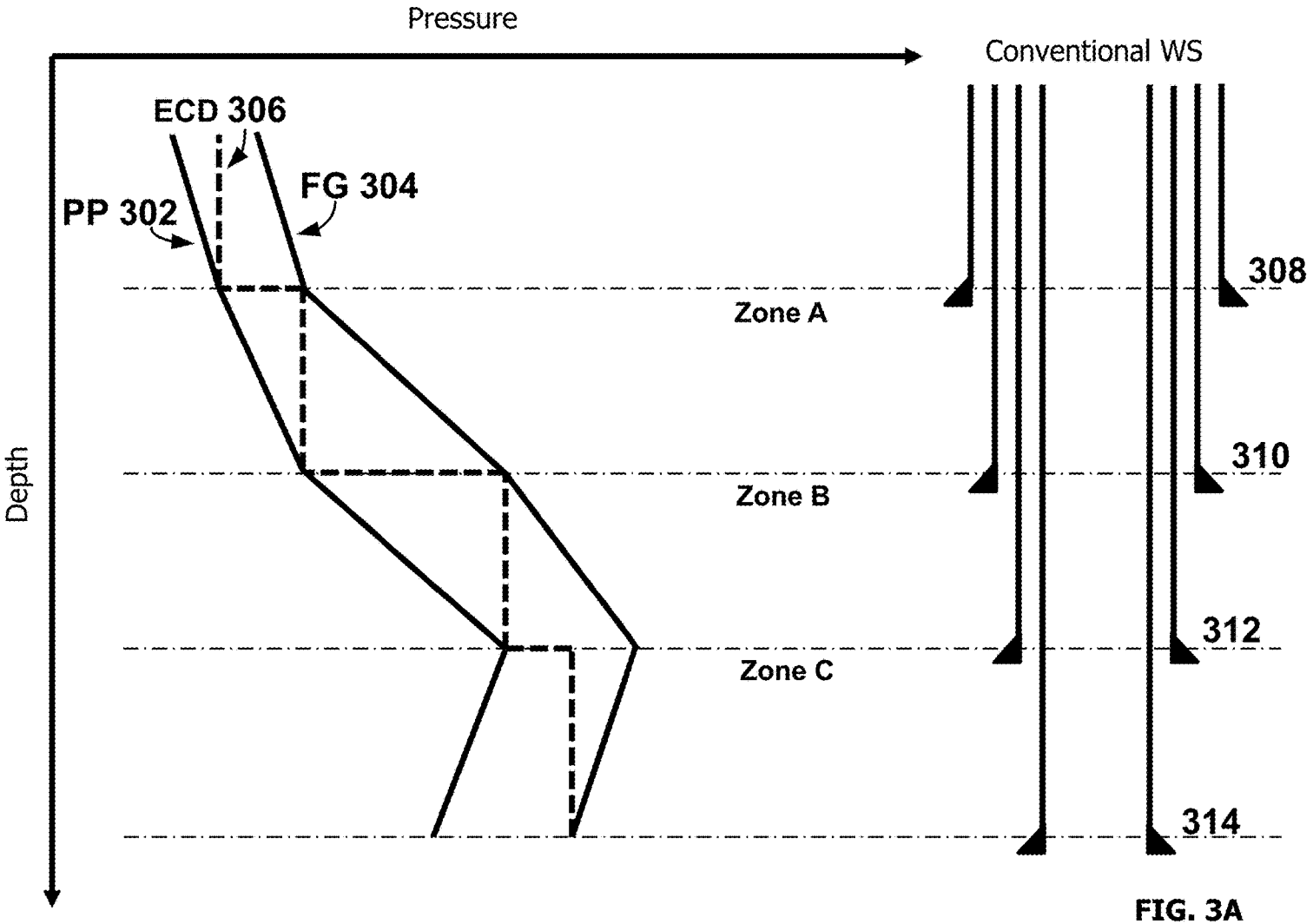
FIGS. 3A-3D are graphs of depth versus pressure and fracture gradient during drilling of a wellbore having various zones, with required casing strings for each graph according to one or more disclosed embodiments.

FIG. 3A shows a graph of pressure versus depth in a wellbore having the illustrated pore pressure (PP) 302 and fracture gradient (FG) 304. Because of change in fracture gradient of the wellbore between zones A, B, and C, in a conventional drilling operation, each of those zone would need to be isolated using a casing string to avoid wellbore instability problems. This means, at least three casing strings would need to be used in drilling this wellbore in addition to the surface casing. These casing strings are shown in FIG. 3A as casing strings 308, 310, 312 and 314. Using these casing strings helps isolate the zones with lower fracture gradients and allows the ECD 306 to be used in drilling these zones. However, as discussed above, running casing strings in a wellbore is expensive, time consuming and difficult, and limits ultimate wellbore size. Thus, it is generally desirable to decrease the number of casing strings needed in a wellbore.

Figure 3B:
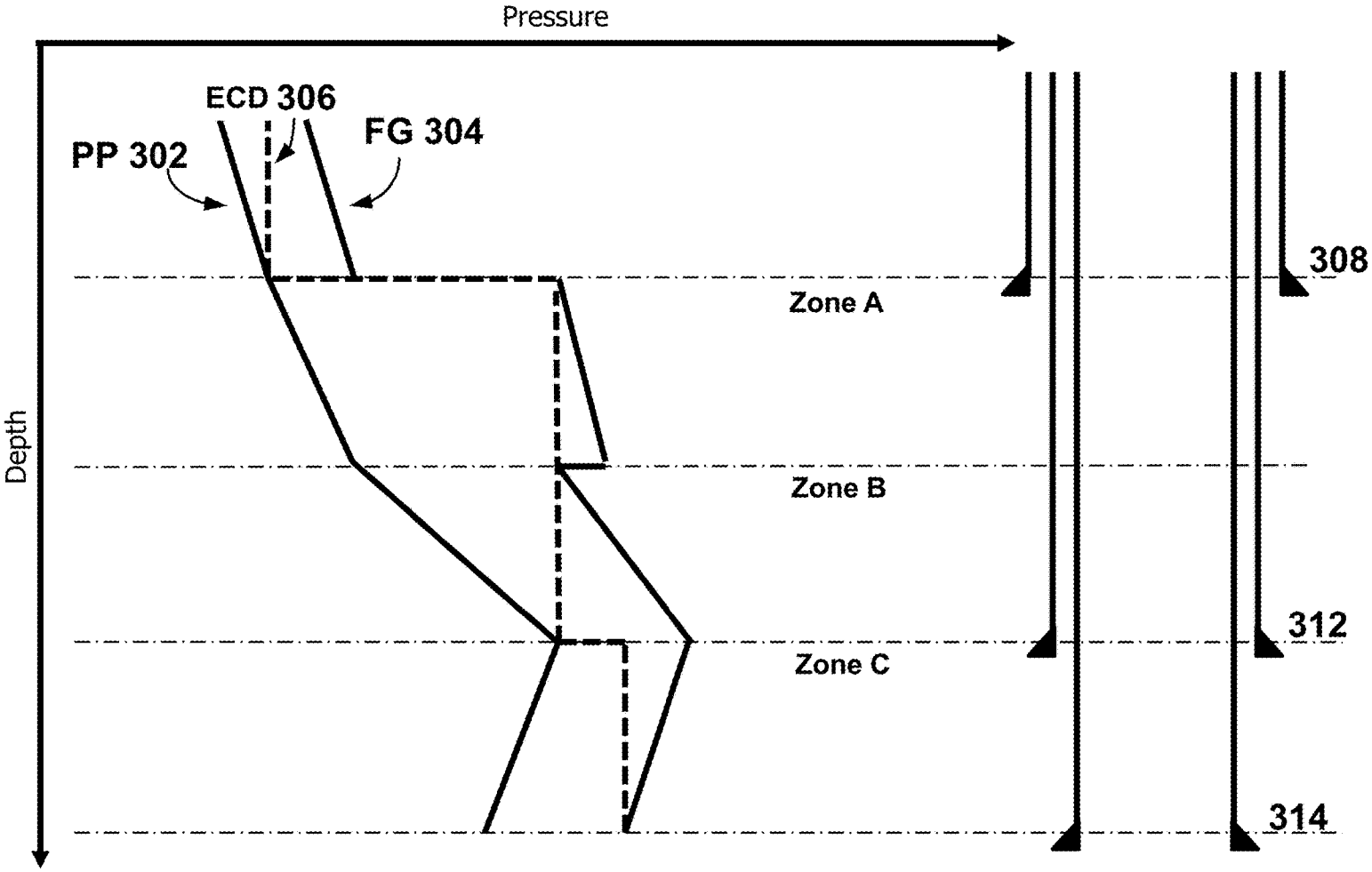

By applying MPWS, the number of casing strings needed for the wellbore shown in FIG. 3A can be decreased. For example, as shown in FIG. 3B, zone A can be strengthened through MPWS, such that zone B can be safely drilled without exceeding the FG of zone A, thus avoiding the need for a casing string at the border region between zone A and zone B. However, as shown in FIG. 3B, two casing strings are still needed for zones B and C in addition to the surface casing.

Figure 3C:
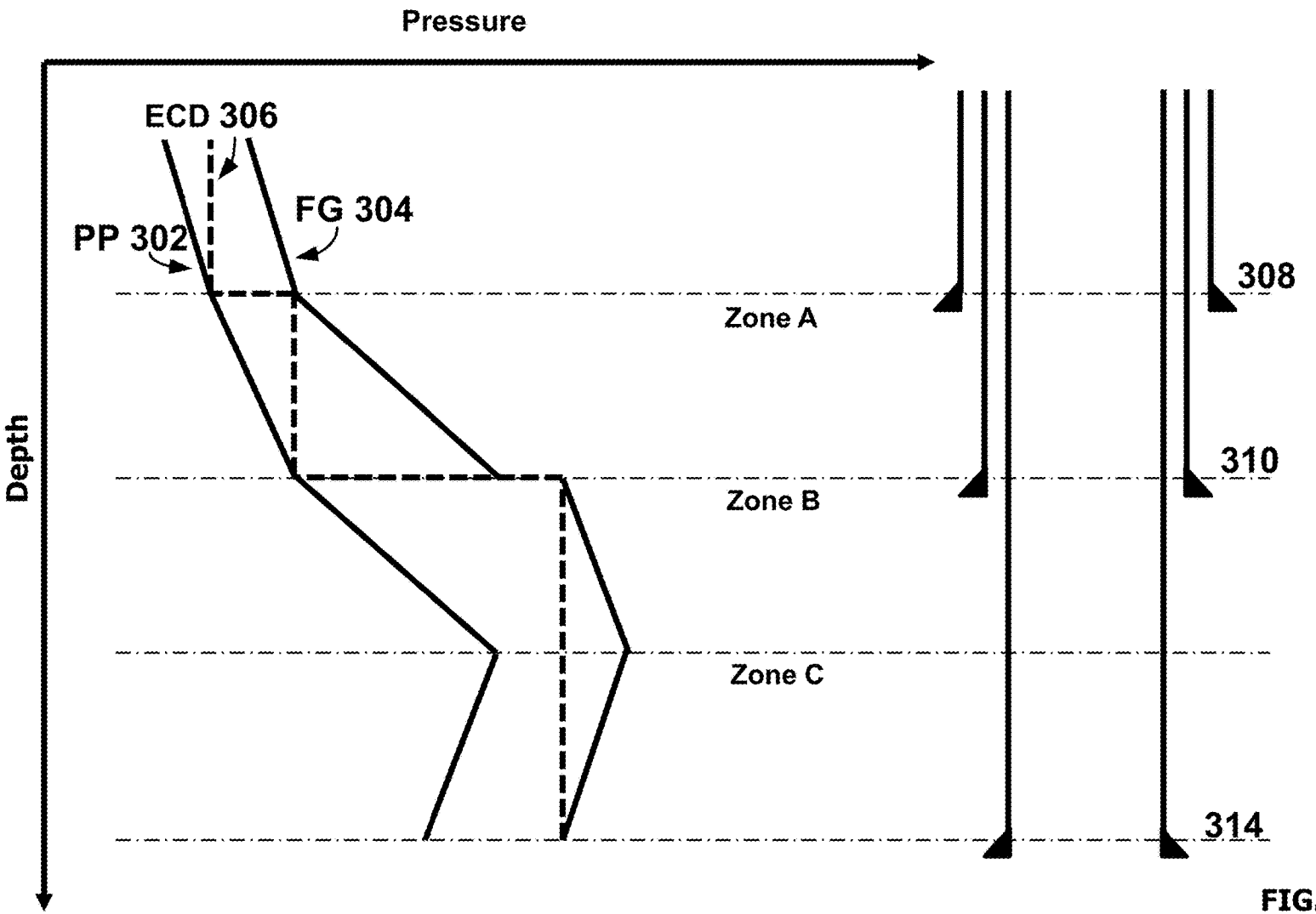

FIG. 3C shows how by strengthening zone B through application of MPWS, fracture gradient of zone B can be increased such that zones B and C can be drilled using the same mud weight. This avoids the need for a casing string between zones B and C, thus reducing the number of required casing strings.

Figure 3D:
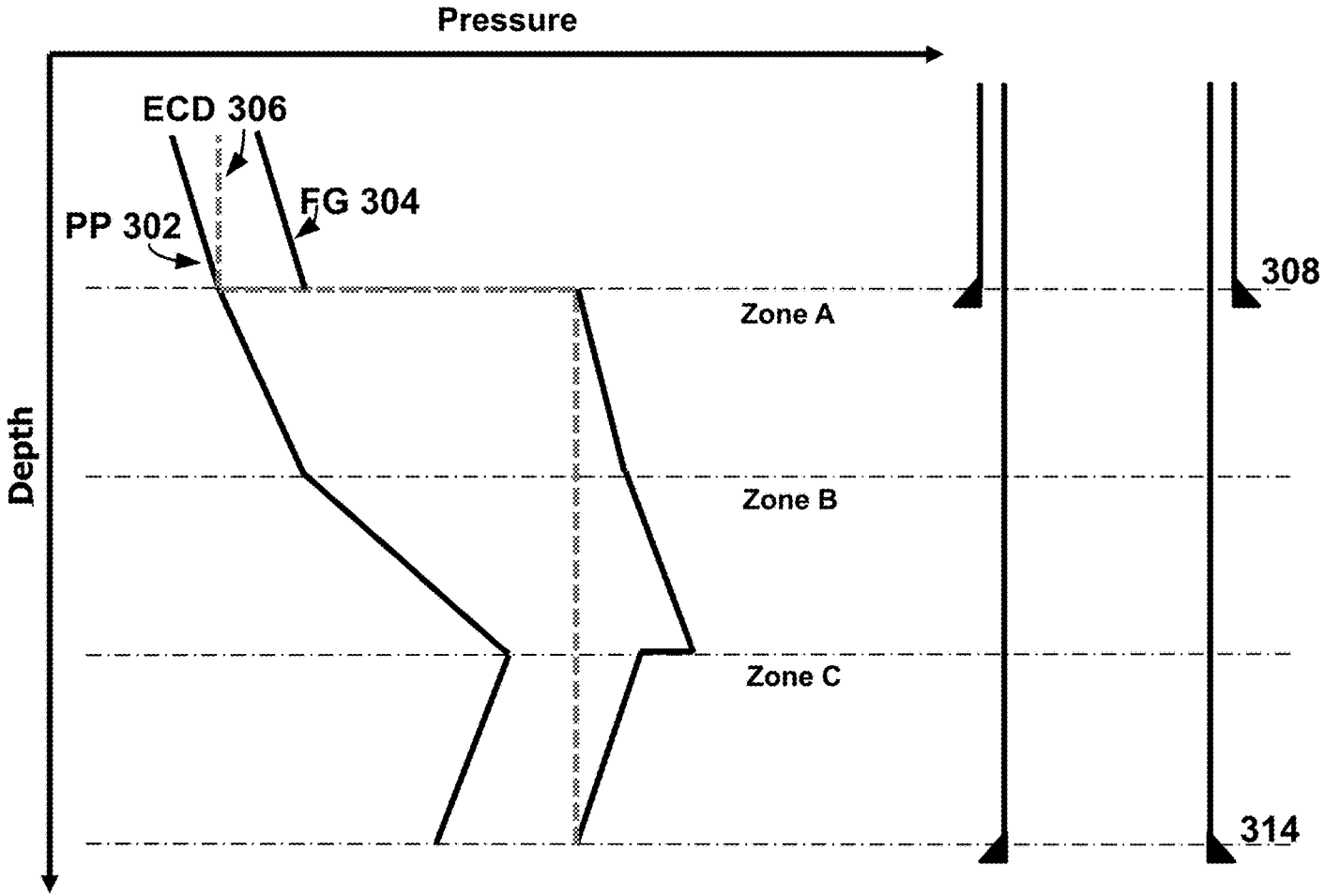

FIG. 3D illustrates how strengthening two zones (zones A and B) by applying MPWS, can increase the fracture gradient in those zones such that all zones can be drilled with the same mud weight eliminating the need for setting additional strings. This reduces the number of casing strings needed for drilling the whole interval to two, thus saving time and significantly reducing cost.

In the foregoing description, for purposes of explanation, specific details are set forth in order to provide a thorough understanding of the disclosed embodiments. It will be apparent, however, to one skilled in the art that the disclosed embodiments may be practiced without these specific details. In other instances, structure and devices are shown in block diagram form in order to avoid obscuring the disclosed embodiments. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one disclosed embodiment, and multiple references to "one embodiment" or "an embodiment" should not be understood as necessarily all referring to the same embodiment.

It is also to be understood that the above description is intended to be illustrative, and not restrictive. For example, above-described embodiments may be used in combination with each other and illustrative process acts may be performed in an order different than discussed. Many other embodiments will be apparent to those of skill in the art upon reviewing the above description. The scope of the invention therefore should be determined with reference to the appended claims, along with the full scope of equivalents to which such claims are entitled. In the appended claims, terms "including" and "in which" are used as plain-English equivalents of the respective terms "comprising" and "wherein."

What is claimed is:

1. A method for strengthening a wellbore, the method comprising:

drilling at least one region of the wellbore during a drilling operation with drilling fluid having a mud weight;

determining an amount of surface back pressure sufficient to induce at least one fracture in the at least one region of the wellbore with the drilling fluid having the mud weight by analyzing leak-off data of the at least one region;

inducing, during the drilling of the at least one region with the drilling fluid having the same mud weight, the at least one fracture in the at least one region of the wellbore by applying the determined amount of surface back pressure to the at least one region during the drilling of the at least one region and limiting fluid loss of the drilling fluid to the at least one region past a leak-off point in the inducement of the at least one fracture during the drilling of the at least one region;

plugging the at least one fracture during the drilling of the at least one region; and strengthening the at least one region of the wellbore with the inducement and the plugging of the at least one fracture during the drilling of the at least one region.

2. The method of claim 1, wherein determining the amount of surface pressure comprises determining the amount sufficient to induce the at least one fracture having a specific fracture length and a specific fracture width profile configured to increase a fracture gradient of the at least one region.

3. The method of claim 2, wherein the specific fracture length is a predetermined length or is calculated using a geomechanical engine.

4. The method of claim 2, wherein applying the determined amount of surface back pressure to the at least one region comprises applying the amount of surface back pressure designed to induce the at least one fracture having the specific fracture length.

5. The method of claim 2, wherein the increase in fracture gradient is a predetermined value or is calculated using a geomechanical engine to optimize a number of required casing strings.

6. The method of claim 2, wherein applying the determined amount of surface back pressure to the at least one region comprises applying the amount of surface back pressure designed to induce the at least one fracture causing the increase in fracture gradient.

7. The method of claim 2, wherein the specific fracture width profile is predetermined or is calculated using a geomechanical engine.

8. The method of claim 2, wherein applying the determined amount of surface back pressure to the at least one region comprises applying the amount of surface back pressure designed to induce the at least one fracture having the specific fracture width profile.

9. The method of claim 2, wherein applying the determined amount of surface back pressure to the at least one region comprises applying the amount of surface back pressure designed to induce the at least one fracture having the specific fracture length and width profile.

10. The method of claim 2, wherein the induced fracture increases the fracture gradient to a predetermined value.

11. The method of claim 1, wherein the surface back pressure is applied by at least one of: a pressure regulator and adjusting a pumping rate of one or more pumps.

12. The method of claim 1, wherein applying the determined amount of surface back pressure to the at least one region comprises applying an initial amount of surface back pressure initially applied to the at least one region selected from a range of pre-determined initial surface back pressures, and wherein after applying the initial amount of surface back pressure, the method further comprises:

applying more surface back pressure in response to a first determination that a combination of the initial surface back pressure and an amount of the mud weight in the wellbore is less than the leak-off point; and predicting fracture geometry in response to a second determination that the combination of the initial surface back pressure and the amount of the mud weight in the wellbore is more than the leak-off point.

13. The method of claim 12, further comprising applying more surface back pressure in response to the predicted fracture geometry being determined to not exceed a predetermined threshold; and wherein plugging the at least one fracture during drilling of the at least one region comprises plugging the at least one fracture in response to the predicted fracture geometry being determined to exceed the predetermined threshold.

14. The method of claim 1, comprising:

providing a drilling tool having a pressure regulator, and a programmable logic controller communicatively coupled to the pressure regulator, the programmable logic controller also coupled to a geomechanical engine;

wherein determining the amount of surface back pressure comprises determining, using the programmable logic controller and the geomechanical engine, the amount of surface back pressure required to induce the at least one fracture having a specific length and a specific width profile; and wherein applying the surface back pressure comprises instructing the pressure regulator to adjust its setting to achieve the amount of surface back pressure required; and applying, using the pressure regulator, the amount of surface back pressure to the wellbore to induce the at least one fracture.

15. The method of claim 14, wherein the at least one induced fracture increases a fracture gradient of at least one region of the wellbore.

16. The method of claim 15, further comprising determining, using the geomechanical engine, an increase in fracture gradient which would minimize a number of casing strings needed for the wellbore.

17. The method of claim 14, wherein the amount of surface back pressure is applied during a managed pressure drilling operation.

18. The method of claim 14, wherein the drilling tool further comprises at least one of a rotating control device, a blowout preventer, and a diverter.

19. The method of claim 14, wherein the pressure regulator is a choke valve.

20. The method of claim 14, further comprising readjusting the settings of the pressure regulator until the at least one fracture is induced, in response to the amount of surface back pressure applied to the wellbore failing to induce the at least one fracture.

21. The method of claim 14, further comprising determining, using the programmable logic controller and the geomechanical engine, a first amount of surface back pressure required to initiate the at least one fracture and a second amount of surface back pressure required to propagate the at least one fracture to have the specific length, the specific width profile, and a specific height.

22. The method of claim 1, comprising:

providing a drilling tool having a pressure regulator, and a programmable logic controller communicatively coupled to the pressure regulator, the programmable logic controller also coupled to a geomechanical engine;

wherein determining the amount of surface back pressure comprises determining, using the programmable logic controller and the geomechanical engine, a first amount of surface back pressure required to initiate the at least one fracture and a second amount of surface back pressure required to propagate the at least one initiated fracture to a specific geometry; and wherein applying the amount of surface back pressure comprises instructing the pressure regulator to adjust its setting to achieve the first amount of surface back pressure required to initiate the at least one fracture; and applying to the wellbore, using the pressure regulator, the first amount of surface back pressure required to initiate the at least one fracture.

23. The method of claim 22, further comprising applying to the wellbore, using the pressure regulator, the second amount of surface back pressure required to propagate the at least one fracture to the specific geometry.

24. The method of claim 23, wherein plugging the at least one fracture during the drilling of the at least one region comprises plugging the at least one initiated fracture to inhibit further fluid loss.

25. The method of claim 1, wherein determining the amount of surface back pressure comprises at least one of:

increasing the surface back pressure incrementally until fracture initiation is observed; and estimating the amount of surface back pressure responsive to detecting ballooning at one or more known depths.

26. The method of claim 1, wherein to strengthen the at least one region of the wellbore with the inducement and the plugging of the at least one fracture, plugging the at least one fracture during the drilling of the at least one region comprises at least one of: plugging the at least one fracture with fluid particles; increasing near wellbore hoop stress and fracture gradient by plugging the at least one fracture with a fluid particle distribution; plugging and holding open the at least one fracture by inserting solid material in the at least one fracture; plugging the at least one fracture by pumping a lost circulation material into the at least one fracture; and plugging the at least one fracture by applying a strengthening material.

27. A system for strengthening a wellbore, the system comprising:

a device being operable to apply pressure to the wellbore; and a controller communicatively coupled to the device and operable to perform a method for strengthening the wellbore according to claim 1.

28. The system of claim 27, wherein the device comprises one or more of a managed pressure drilling system, a manual pressure regulator, a semi-automatic pressure regulator, an automatic pressure regulator, a hydraulic pressure regulator, a rig pump, a pressure pump, a positive displacement pump, a choke manifold, and a choke valve.

29. The system of claim 28, further comprising one or more of a drilling tool, a rotating control device, a blowout preventer, a diverter, a mud gas separator, and a centrifuge in fluid communication with the device.

30. The system of claim 28, wherein the device comprises a pressure regulator;

wherein the controller comprises a programmable logic controller communicatively coupled to the pressure regulator; and wherein the programmable logic controller is configured to determine an amount of surface back pressure required to induce a fracture having a specific geometry in the wellbore and to instruct the pressure regulator to adjust its setting to achieve the amount of surface back pressure; and wherein the pressure regulator is configured to apply the amount of surface back pressure to the wellbore.

31. The system of claim 30, wherein the pressure regulator is manual, semi-automatic, automatic, or hydraulic.

32. The system of claim 30, wherein the programmable logic controller communicates the amount of pressure required to the pressure regulator through use of hydraulic pressure.

33. The system of claim 27, wherein the controller comprises one or more of an intelligent control unit, a hydraulic power unit, a display, a flow meter, a pressure sensor, and a programmable logic controller having a geomechanical engine.

34. A method of drilling a wellbore, the method comprising:

identifying one or more regions of a wellbore for strengthening during drilling of the wellbore in a drilling operation;

drilling a first of the one or more regions of the wellbore with drilling fluid having a mud weight;

determining a first amount of surface back pressure sufficient to induce first fracturing in the first region with the drilling fluid having the same mud weight by analyzing leak-off data of the first region;

inducing, during the drilling of the first region with the drilling fluid having the same mud weight, the first fracturing in the first region by applying the first amount of surface back pressure to the first region and limiting fluid loss of the drilling fluid to the first region past a first leak-off point in the inducement of the first fracturing;

plugging the first fracturing during the drilling of the first region; and strengthening the first region of the wellbore with the inducement and the plugging of the first fracturing during the drilling of the first region.

35. The method of claim 34, wherein identifying the one or more regions for strengthening during the drilling of the wellbore through the one or more regions comprises identifying the one or more regions using information of pore pressure and fracture gradient verses depth for the wellbore.

36. The method of claim 34, wherein to strengthen the first region of the wellbore with the inducement and the plugging of the first fracturing, plugging the first fracturing during the drilling of the first region comprises at least one of: plugging the at least one fracture with fluid particles; increasing near wellbore hoop stress and fracture gradient by plugging the at least one fracture with a fluid particle distribution; plugging and holding open the at least one fracture by inserting solid material in the at least one fracture; plugging the at least one fracture by pumping a lost circulation material into the at least one fracture; and plugging the at least one fracture by applying a strengthening material.

37. The method of claim 34, further comprising:

drilling, subsequent to the first region, a second of the one or more regions of the wellbore with the drilling fluid having the same mud weight;

determining a second amount of surface back pressure sufficient to induce second fracturing in the second region with the drilling fluid having the same mud weight by analyzing leak-off data of the second region;

inducing, during the drilling of the second region with the drilling fluid having the same mud weight, the second fracturing in the second region by applying the second amount of surface back pressure to the second region and limiting fluid loss of the drilling fluid to the second region past a second leak-off point in the inducement of the second fracturing;

plugging the second fracturing during the drilling of the second region; and strengthening the second region of the wellbore with the inducement and the plugging of the second fracturing during the drilling of the second region.

38. The method of claim 37, further comprising isolating the first and second regions with a same casing string in the wellbore.

39. The method of claim 37, further comprising:

drilling, subsequent to the second region, a third of the one or more regions of the wellbore with the drilling fluid having the same mud weight;

determining a third amount of surface back pressure sufficient to induce third fracturing in the third region with the drilling fluid having the same mud weight by analyzing leak-off data of the third region;

inducing, during the drilling of the third region with the drilling fluid having the same mud weight, the third fracturing in the third region by applying the third amount of surface back pressure to the third region and limiting fluid loss of the drilling fluid to the third region past a third leak-off point in the inducement of the third fracturing;

plugging the third fracturing during the drilling of the third region; and strengthening the third region of the wellbore with the inducement and the plugging of the third fracturing during the drilling of the third region.

40. The method of claim 39, further comprising isolating the first, second, and third regions with a same casing string in the wellbore.

* * * * *